United States Patent [19]

LaVine, Jr.

[11] Patent Number: 4,854,505

[45] Date of Patent: Aug. 8, 1989

[54] INJECTION VALVE FOR LAWN TREATMENT SYSTEM

[75] Inventor: M. Joseph LaVine, Jr., Niles, Mich.

[73] Assignee: Ag-Chem Equipment Co., Inc., Minneapolis, Minn.

[21] Appl. No.: 93,036

[22] Filed: Sep. 4, 1987

[51] Int. Cl.[4] ..... B05B 7/04

[52] U.S. Cl. ..... 239/304; 137/605; 239/308; 239/417.3; 239/586

[58] Field of Search ..... 239/304, 308, 310, 417.3, 239/417.5, 586, 587, 305; 137/605

[56] References Cited

U.S. PATENT DOCUMENTS

| | | | |
|---|---|---|---|
| 1,732,401 | 10/1929 | Fausek et al. . | |
| 1,734,927 | 11/1929 | Tritz | 239/587 |
| 2,199,110 | 4/1940 | Metz | 239/310 |
| 2,616,660 | 11/1952 | Morehouse | 239/417.5 |
| 2,640,724 | 6/1953 | Sanders, et al. | 239/304 |
| 2,672,187 | 3/1954 | Smith | 239/587 |
| 3,129,892 | 4/1964 | Tillman | 239/417.3 |
| 3,375,978 | 4/1968 | Rennie | 239/113 |
| 3,770,208 | 11/1973 | Mueller | 239/417.3 |
| 3,907,207 | 9/1975 | O'Brien | 239/417.3 |
| 4,089,470 | 5/1978 | Strahman | 239/304 |
| 4,572,483 | 2/1986 | Leu . | |
| 4,609,149 | 9/1986 | Jessen | 239/310 |

FOREIGN PATENT DOCUMENTS

| | | | |
|---|---|---|---|
| 635272 | 3/1928 | France | 239/304 |

*Primary Examiner*—Andres Kashnikow
*Assistant Examiner*—Michael J. Forman
*Attorney, Agent, or Firm*—Orrin M. Haugen; Thomas J. Nikolai; Frederick W. Niebuhr

[57] ABSTRACT

An improved valve for use in combination with a hand-held nozzle for a lawn treatment system which is designed to allow selective application of a second liquid chemical by the operator in conjunction with the application of a first liquid chemical. The system includes separate pressurized sources for each of the two chemicals as well as a pair of hoses concentric with each other, each hose communicating with one of said pressurized sources and said valve. The nozzle includes means for connecting the hose associated with the first pressurized source, means for connecting the hose associated with the second pressurized source, and an operator controlled valve means for permitting and restricting flow of said second chemical through the valve, a nozzle, and means for connecting a nozzle to the valve.

3 Claims, 1 Drawing Sheet

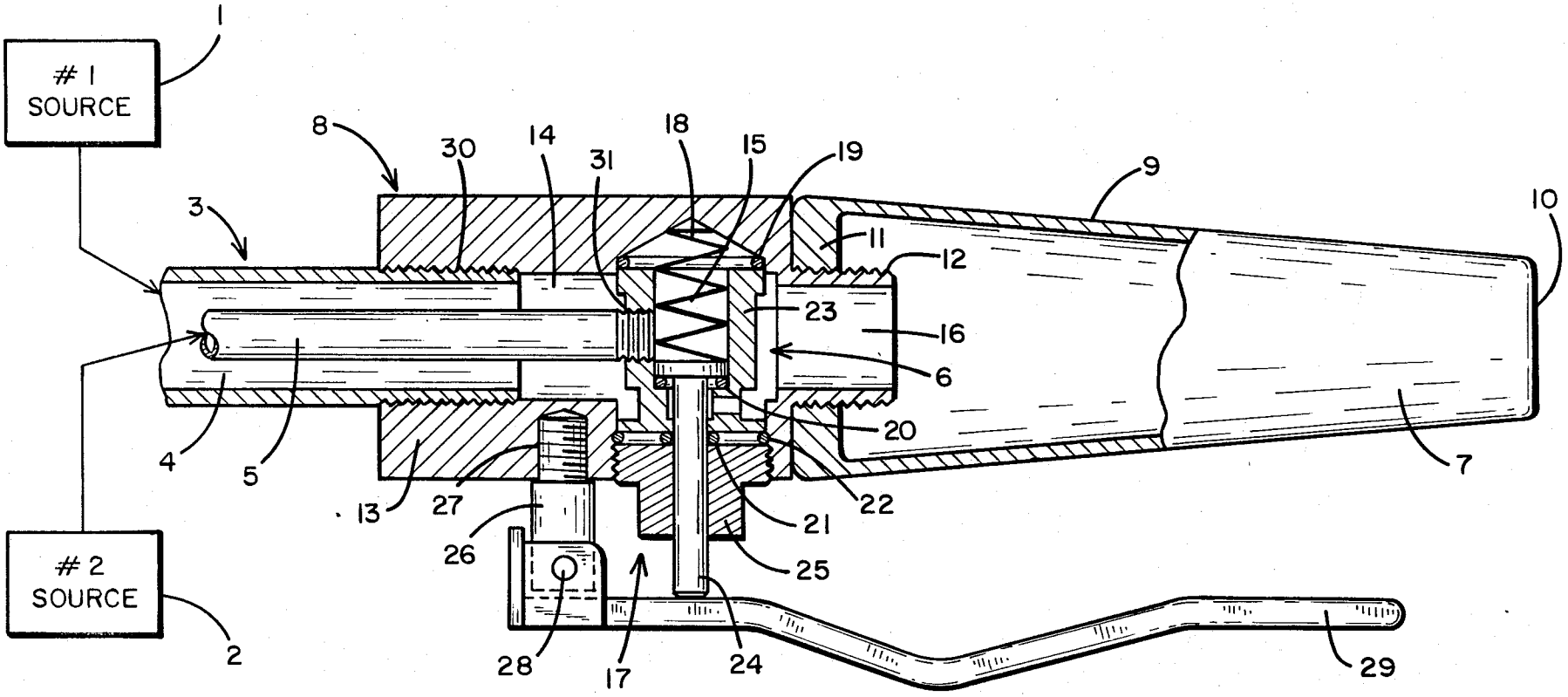
10
7
29
9
12
16
6
20
22
11
19
23
21
25
15
24
18
17
31
14
28
30
27
26
13
8
5
1
3
4
2
1 SOURCE
2 SOURCE

INJECTION VALVE FOR LAWN TREATMENT SYSTEM

BACKGROUND OF THE INVENTION

Recently, lawn treatment services have been popping up and growing like weeds throughout the United States. While several years ago companies providing such services concentrated on business, apartment and condominium type complexes, now such services are routinely provided for those owning single family homes. Customers who purchase such services generally desire to have a beautiful, weed-free lawn without all of the effort associated with pulling weeds and spreading fertilizers, pesticides or other herbicide products themselves.

With the growth in demand for lawn treatment services, those involved in applying herbicides, pesticides or fertilizers are generally busier. Further, even before this increased demand for such services, the operator's job was strenuous. This job involves manipulating nozzles while literally dragging long lengths of pressurized fluid-filled hoses across the lawn. This is done all day long during adverse weather conditions including some of the hottest months of the year. The strain can cause operators to become fatigued and tired long before the end of the work day.

Because the chemicals applied are generally equally available to all of the competing services, the key ingredient in developing a superior reputation in the industry is the demonstration of a great deal of care and precision in applying herbicides, pesticides, or fertilizers in the correct dilution ratios. Stated otherwise, the operator must make sure that the right materials are applied in precisely the right place and also in the appropriate ratios of active ingredient to water. Failure to take such care may cause damage to plants, flowers or the like. Thus, there is a real need in the industry for equipment which enables the operator to easily, carefully and accurably apply the desired materials in the desired place and in the desired ratio without residual amounts being sprayed in undesired locations where they can cause severe damage to adjacent gardens, shrubs or trees.

SUMMARY OF THE INVENTION

The present invention relates in general to a spray system including an injection valve used in conjunction with a nozzle of a lawn treatment system and, more specifically, to a unique valve for applying a first liquid chemical at an appropriate dilution along with a regulated amount of a second liquid chemical to a lawn.

The principal object of the present invention is to provide an injection valve for a lawn treatment system adapted to permit selective application of a second chemical solution as an incident to the application of a first liquid through the nozzle.

Another important object of this invention is to provide an injection valve of the character set forth above which provides the operator with direct control of the flow of the second solution through a nozzle at all times during operation.

A further object of the invention is to provide an injection valve operable in combination with a nozzle and adapted for one-handed operation in a fashion which provides an easily operated valve for interruption or inhibiting flow of one component or mixture individually.

Still another object of the invention is to provide a nozzle in combination with an improved injection valve of the type described above which is so situated to preclude residual amounts of the second liquid chemical from being applied after the valve has been shut off by the operator.

Other objects and advantages of the invention become apparent in view of the following description and claims taken together with the accompanying drawing.

BRIEF DESCRIPTION OF THE DRAWING

FIG. 1 shows the injection valve of the present invention in combination with a nozzle assembly.

DETAILED DESCRIPTION OF THE PREFERRED EMBODIMENT

Referring to the drawing, a lawn treatment system of the present invention is exemplified as including a pressurized source 1 of a first liquid chemical, a pressurized source 2 of a second liquid chemical, a length of hose 3 including a first conduit 4 and second conduit 5, and an injection valve 6 and a nozzle 9. Typically, the first liquid chemical would be water or a suitable generic fertilizer. The second liquid chemical would most typically be a more particularized fertilizer or a herbicide or pesticide.

As should be apparent from the drawing, the hose 3 has an upstream end and a downstream end. The two conduits 4 and 5 of hose 3 are concentric with respect to each other. It is desirable that this be so along a substantial portion of the respective lengths of conduits 4 and 5 because it permits the operator to manipulate both conduits with one hand at the same time. If the two conduits were in separate hoses, this type of manipulation would be a much more difficult task. Also, this configuration prevents kinking of the smaller conduit while the apparatus is in use or while the hose is being dragged across the lawn. Having conduits 4 and 5 within the same hose 3 is possible because of their relative diameters. The diameters are such that conduit 5 can easily be placed inside of conduit 4 without significantly disrupting flow through either conduit. With this configuration, flow occurs through the channel of inner conduit 5, and the annular zone of conduit 4 which surrounds conduit 5.

The valve 6 includes an outer shell which is not shown so that the interior of the design can be viewed. Associated with valve 6 is a nozzle 9. The nozzle 9 includes an outer shell 7 and is hollow along most of its length. Both ends of the nozzle have suitable openings to permit flow from the valve 6 out through the end 10 of the nozzle. Associated with the upstream end of the nozzle 9 is a female threaded member 11 which is intended to mate with a corresponding male threaded member 12 associated with the primary housing 8 of the valve 6. To ensure a liquid impermeable union between the primary housing 8 and the nozzle 9, a gasket (not shown), may be provided.

Of substantial significance to the present invention is the construction of the primary housing 8 of the valve 6. As shown in the drawing, the primary housing 8 has a generally cylindrical shaped outer wall 13. Contained within this outer wall is a first flow path 14, a second flow path 15 which merges with flow path 14 to provide a unified flow path 16, and an actuatable valving member 17. The actuatable valving member 17 has an open position and a closed position. The valving member 17 is disposed within (an only within) the second flow path 15 at a location immediately upstream of the point where flow paths 14 and 15 merge to form unified flow path 16. The valving member 17 includes a compression spring 18, four quadrings which are designated 19, 20, 21 and 22 respectively, a valve insert 23, a valve pin 24 and a gland nut 25.

Also associated with the primary housing 8 of valve 6 is a pivot member 26. Pivot member 26 can be secured to the primary housing as shown at 27 in a number of different ways including the use of a weldment or threaded connecting members. Attached to the pivot member 26 by a pivot pin 28 is handle 29. The handle 29 is designed so that it will contact the pivot pin 24. When the handle is pulled toward the valve 6, it pivots about pin 25 and compresses the valve pin 24 against spring 18. This action opens the valving member 17 to permit pressurized materials in the second flow path to flow path the valve. When the handle 29 is released, the compression spring 18 in the valve causes the valve to close inhibiting further passage of material past the valve.

When the apparatus of the present invention is assembled, the outer conduit 4 of the hose 3 is attached at its upstream end to pressurize source 1 and at its downstream end to the first flow path of the valve 6. Likewise, the inner conduit 5 is attached at its upstream end to the pressurized source 2 and at its downstream end to the second flow path of the valve 6. It is contemplated that each of these connections can be easily made through the use of connecting means comprised of reciprocally threaded male and female connecting members such as 30 and 31. These connections could also be made by means of a pressure fitting, the use of conventional hose clamps, or the like which are typically used to connect hoses to pressurized equipment. When conduits 4 and 5 of hose 3 are so connected, they form communicating passages between the respective pressurized sources and the respective flow paths of the valve 6.

When the lawn treatment system of the present invention is in use and the pressurized sources 1 and 2 are "turned on", there will be a constant flow of material from the first pressurized source 1 through the outer conduit 4, through the first flow path 14 of the valve 6, and out the end 10 of the nozzle 9. Similarly, the system will cause material to flow from the second pressurized source 2 through the inner conduit 5 to the second flow path 15 of the valve 6. However, only when the valving member 17 is in the open position will the second material be able to flow past the valving member 17 where it will mix with the material in the first flow path and flow out of the end 10 of the nozzle 9.

As will immediately be recognized to those skilled in the art in view of the disclosure contained herein, given the structure of the valve 6, the nozzle 9 and the location of the valving member 17, when the valving member 17 is closed, flow of material from the second pressurized source 2 will immediately shut off. Significantly, there is no possibility of residual amounts of material from the second source mixing with the material from the first source as it passes through the valve 6 and the nozzle 9 unless the handle is actuated to open the valving member 17. Thus, it makes it virtually impossible to apply materials from the second source 2 to areas where it is not desired if the operator is careful to release the handle 29 thus closing the valving member 17 before moving into that area.

While a specific embodiment of the present invention has been disclosed, it is to be understood that the disclosed embodiment has been made by way of example and that a variety of changes in the details of construction could be made without deviating from the present invention. Accordingly, the scope of the present invention is to be limited only by the appended claims.

I claim:

1. An agricultural treatment system for applying a first chemical and selectively applying a second chemical through an injection valve, comprising in combination:

(a) a pressurized source of said first chemical; and (b) a pressurized source of said second chemical;

(c) a length of hose having an upstream end and downstream end, a first larger diameter conduit and a second smaller diameter conduit which is concentric with the larger diameter conduit along a substantial portion of the hose;

(d) an injection valve having a first flow path and a second flow path concentric therewith which merges with said first flow path, and an actuable valving means having an open position and closed position in the second flow path at a point just upstream of the point where the first and second flow paths merge;

(e) means for connecting the upstream end of said first conduit to the pressurized source of said first chemical and the downstream end of said first conduit to the first flow path of said injection valve to form a communicating passage which permits said first chemical to continuously flow through said valve whether said valve is the opened or closed position; and (f) means for connecting the upstream end of said second conduit to the pressurized source of said second chemical and the downstream end of said second conduit to the second flow path of said valve to form a communicating passage which permits the second chemical to flow through the valve only when the valve is in the open position and precludes the second chemical from flowing through the valve when the valve is in the closed position.

2. The apparatus of claim 1 further including a handle which is used to actuate the valve between the opened and closed positions.

3. The apparatus of claim 1 further including a nozzle and means for connecting the nozzle to the valve.

* * * * *